US007032976B2

(12) United States Patent
Lin

(10) Patent No.: US 7,032,976 B2
(45) Date of Patent: Apr. 25, 2006

(54) STOOL APPARATUS FOR CHAIR

(75) Inventor: Yu-Jen Lin, Kaohsiung Hsien (TW)

(73) Assignee: Iou Jia Industrial Co., Ltd., Ta-Liao Hsiang (TW)

( * ) Notice: Subject to any disclaimer, the term of this patent is extended or adjusted under 35 U.S.C. 154(b) by 0 days.

(21) Appl. No.: 10/790,314

(22) Filed: Mar. 1, 2004

(65) Prior Publication Data

US 2005/0189808 A1 Sep. 1, 2005

(51) Int. Cl.
*A47C 7/50* (2006.01)
*A47C 16/02* (2006.01)

(52) U.S. Cl. ..... 297/423.21; 297/423.24

(58) Field of Classification Search ..... 297/423.21, 297/423.22, 423.23, 423.4, 173, 411.35, 411.38, 297/408; 248/447.1, 447.2
See application file for complete search history.

(56) References Cited

U.S. PATENT DOCUMENTS 4,589,699 A * 5/1986 Dungan ..... 297/423.12 X
5,769,495 A * 6/1998 Vairinen ..... 297/411.32 X
6,460,933 B1 * 10/2002 Bors et al. ..... 297/440.2 X
6,634,716 B1 * 10/2003 Sander et al. ..... 297/423.19
6,742,754 B1 * 6/2004 Maier-Hunke et al. .. 248/447.1 X
6,824,219 B1 * 11/2004 Ruckstadter ..... 297/423.27

* cited by examiner

*Primary Examiner*—Anthony D. Barfield
(74) *Attorney, Agent, or Firm*—Alan D. Kamrath; Nikolai & Mersereau, P.A.

(57) ABSTRACT

A stool apparatus is provided for a chair. The chair includes a base, a post installed on the base and a seat installed on the post. The stool apparatus includes a stool, a carriage and a telescopic device. The carriage is used for carrying the stool. The telescopic device is used for connecting the carriage to the post.

15 Claims, 10 Drawing Sheets

STOOL APPARATUS FOR CHAIR

FIELD OF INVENTION

The present invention relates to a chair and, more particularly, to a stool for a chair.

BACKGROUND OF INVENTION

Referring to FIGS. 9 and 10, a conventional stool 101 is disclosed for a chair 102 for use in an office. The chair 102 includes a base 122 put on the ground, a post 121 installed on the base 122 and a seat 123 installed on the post 121. The stool 101 defines an aperture 111 for receiving the post 121 so that the stool 101 can be put around the post 121 and on the base 122. The base 122 includes five legs each including an inclined upper face. The stool 101 includes a horizontal lower face. To put the stool 101 on the base 122 well, a block 113 is formed on the lower face of the stool 101 and put on the upper face of one of the legs of the base 122. The stool 101 includes a plurality of bosses 112 for massaging the feet of a user sitting in the chair 102. Several problems are, however, encountered in using the stool 101. Firstly, the stool 101 cannot suit users of different sizes for it can be put in only one vertical position and only a horizontal position relative to the post 121. Secondly, it might be difficult for the user to put his or her feet on the stool 101, because it tends to rotate on the post 121. Thirdly, the user feels uncomfortable putting his or her feet on the stool 101 bending his or her legs.

The present invention is therefore intended to obviate or at least alleviate the problems encountered in the prior art.

SUMMARY OF INVENTION

It is an objective of the present invention to provide a chair with a stool apparatus that can suit users of different sizes.

It is another objective of the present invention to provide a chair with a stool apparatus that users can use with comfort for a long time.

It is another objective of the present invention to provide a chair with a stool apparatus that a user can easily use.

According to the present invention, a stool apparatus is provided for a chair. The chair includes a base, a post installed on the base and a seat installed on the post. The stool apparatus includes a stool, a carriage and a telescopic device. The carriage is used for carrying the stool. The telescopic device is used for connecting the carriage to the post.

Other objectives, advantages and novel features of the present invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
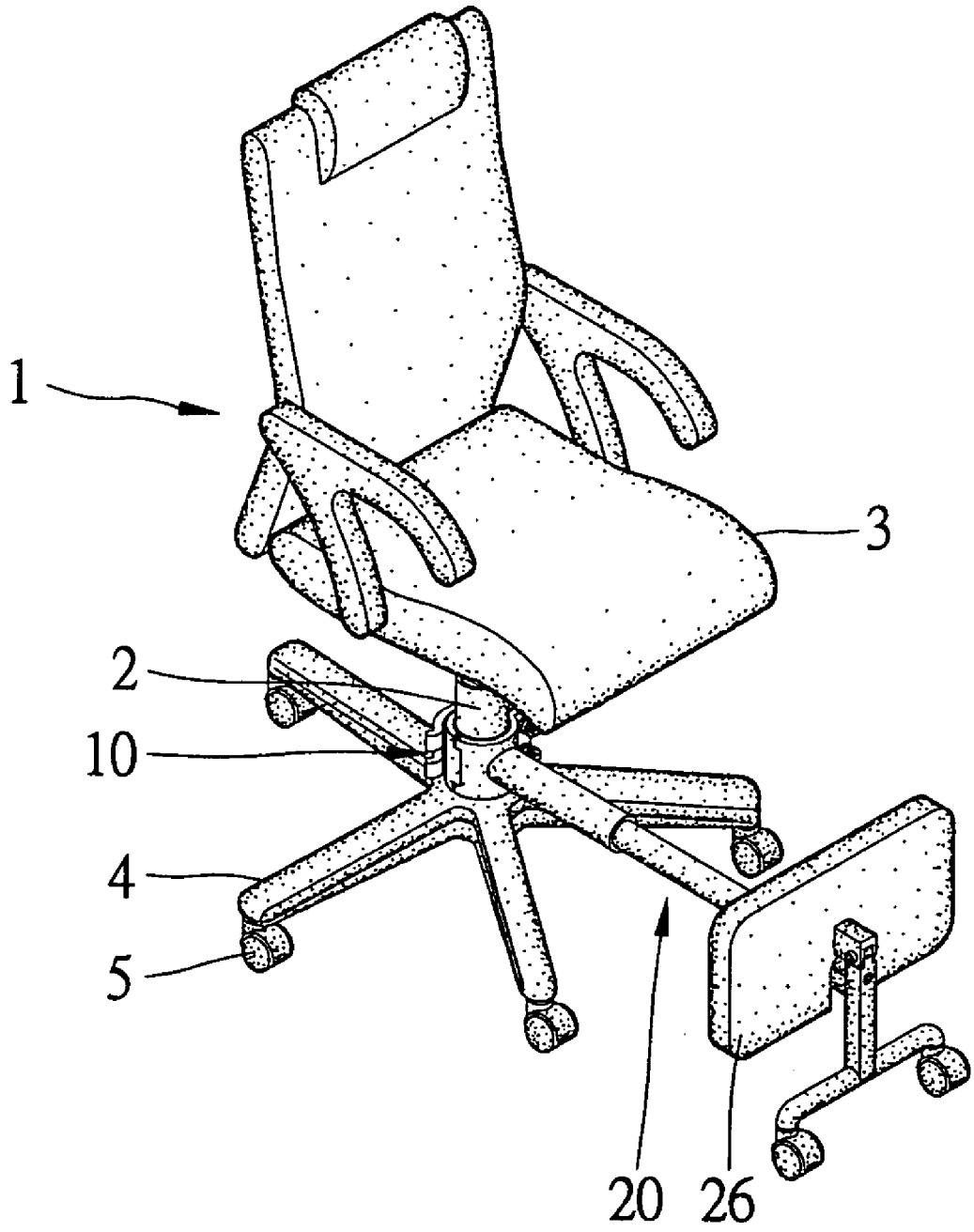
FIG. 1 is a perspective view of a chair equipped with a stool apparatus according to the preferred embodiment of the present invention.

Referring to FIG. 1, a chair 1 is equipped with a stool apparatus 20 according to the preferred embodiment of the present invention. The chair 1 includes a base 4 put on the ground or floor, a post 2 installed on the base 4 and a seat 3 installed on the post 2. The base 4 includes five legs each equipped with a caster 5. The stool apparatus 20 is attached to the post 2 by a clamping device 10.

Figure 2:
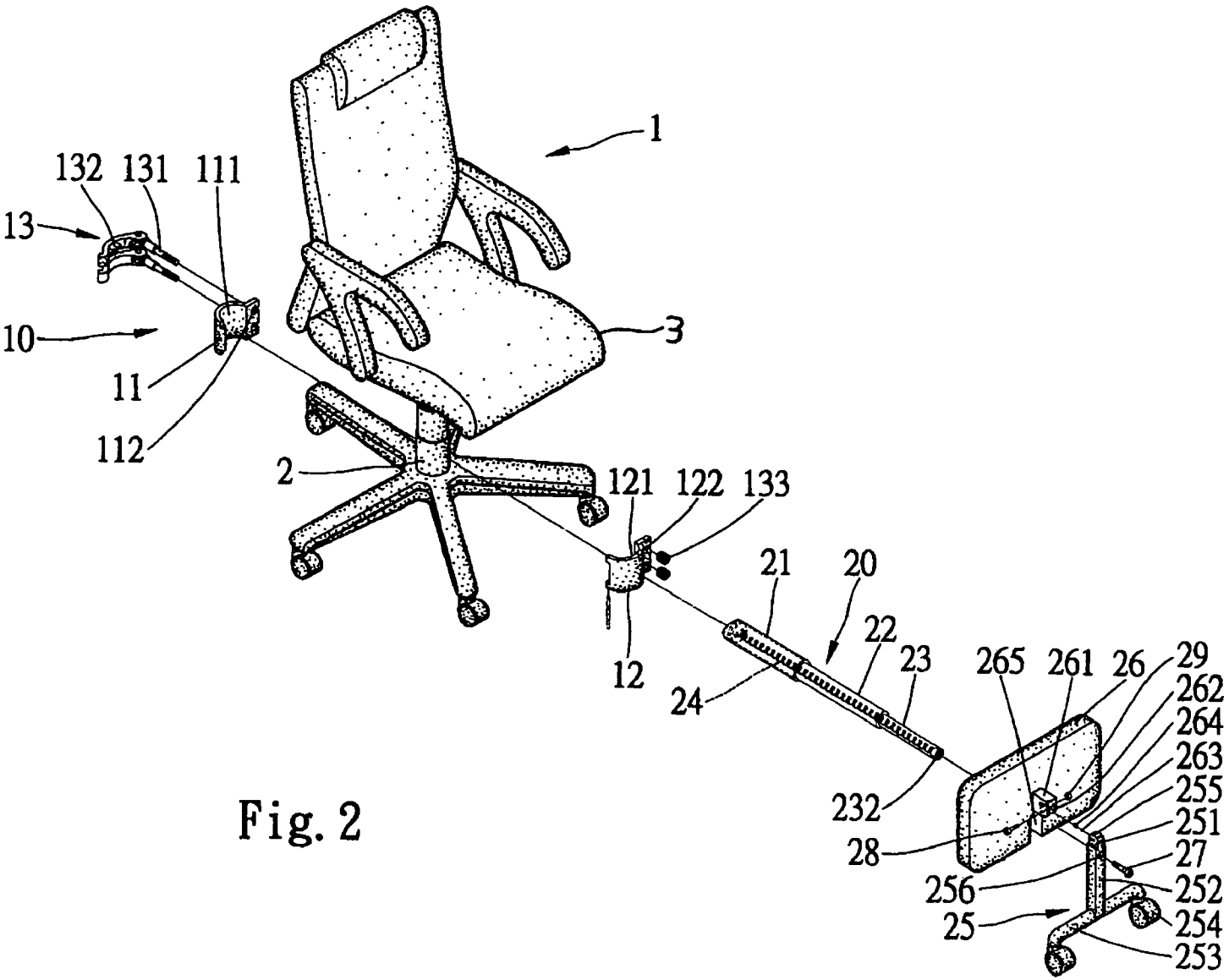
FIG. 2 is an exploded view of the stool apparatus shown in FIG. 1.
Figure 3:
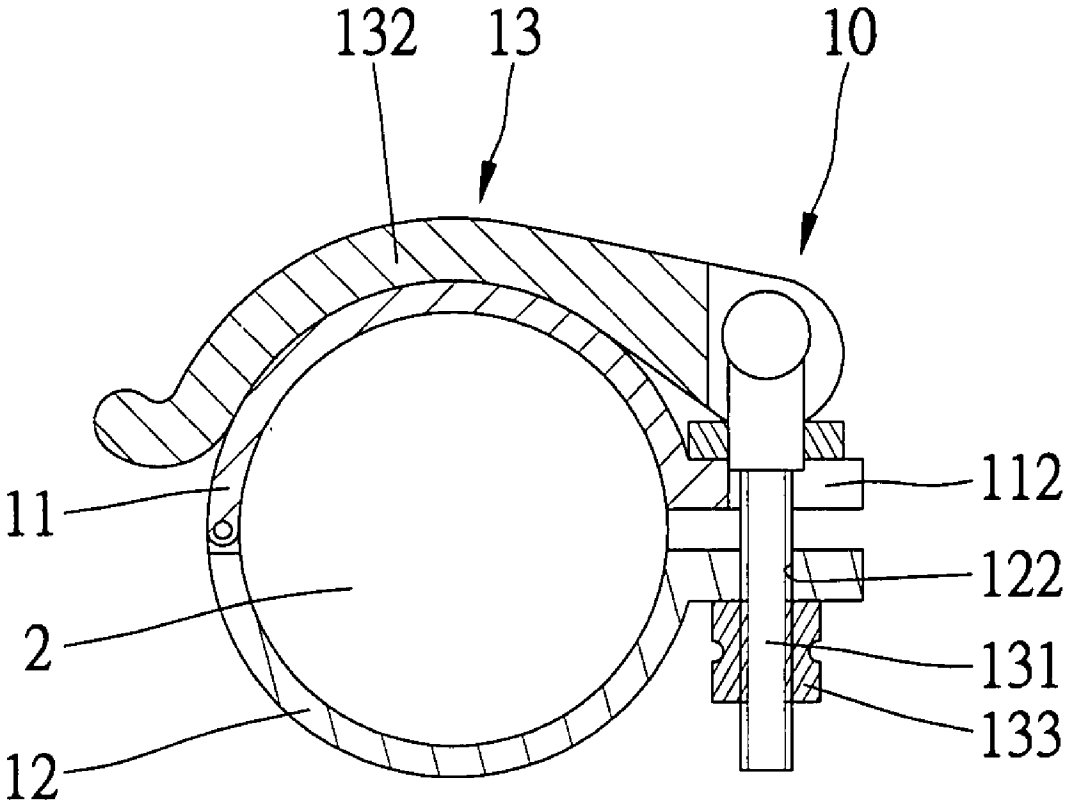
FIG. 3 is an enlarged, cross-sectional view of a clamp of the stool apparatus.
Figure 4:
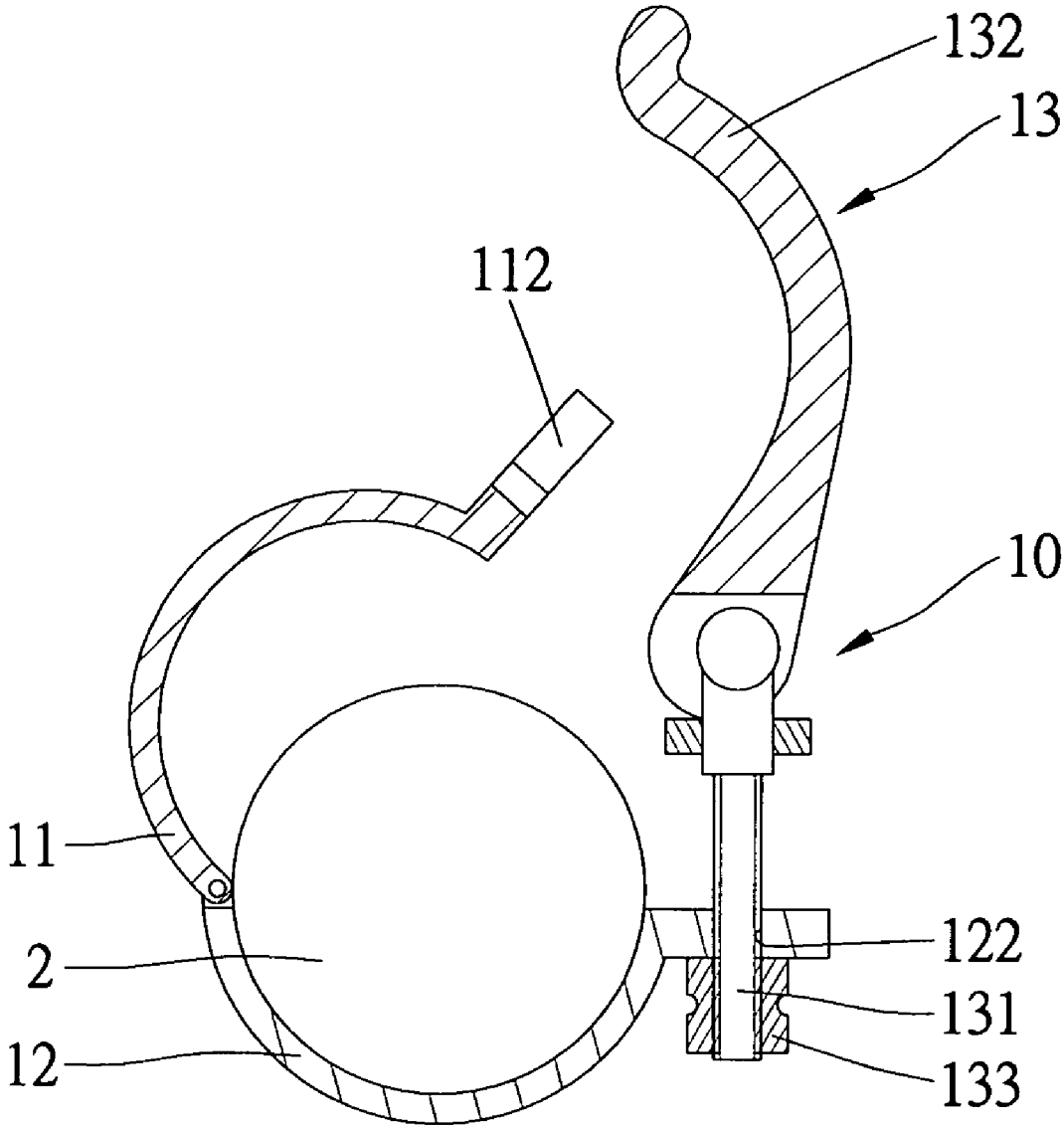
FIG. 4 is similar to FIG. 3 but shows the clamp in a different position.

Referring to FIGS. 2–4, the clamping device 10 includes a first jaw 11, a second jaw 12 and two quick release elements 13. An end of the first jaw 11 is hinged with an end of the second jaw 12. An opposite end of the first jaw 11 defines two cutouts 112. An opposite end of the second jaw 12 defines two holes 122. The first jaw 11 includes a curved face 111 for receiving the post 2. The second jaw 12 includes a curved face 121 for receiving the post 2. Typically, each quick release element 13 includes a screw 131 and a lever/cam 132 hinged with the screw 131. Each screw 131 is inserted into engagement with a nut 133 through related one of the cutouts 112 and related one of the holes 122.

The stool apparatus 20 includes a telescopic device, a tension spring 24 put in the telescopic device, a carriage 25 connected with the telescopic device and a stool 26 installed on the carriage 25.

The telescopic device includes a first tube 21, a second tube 22 inserted in the first tube 21 and a third tube 23 inserted in the second tube 22. The first tube 21 includes a rear end secured to the second jaw 12 via adhesion, welding or any appropriate means. The third tube 23 includes a front end including a plug 231 defining a screw hole 232.

The tension spring 24 includes a rear end attached to the rear end of the first tube 21 and a front end attached to the front end of the third tube 23. The tension spring 24 causes the telescopic device to shrink.

The carriage 25 includes a vertical bar 252 attached to the third tube 23, a horizontal bar 253 integrated with the vertical bar 252 and two wheels 254 attached to the horizontal bar 253. The vertical bar 252 includes a lug 251 formed at an upper end and an aperture 256 defined therein near the upper end.

A screw 27 is driven into the screw hole 232 through the aperture 256 so as to attach the carriage 25 to the telescopic device.

The stool 26 includes two lugs 261. Through the lugs 261 and 251, a screw 28 is driven into engagement with a nut 29 so as to pivotally connect the stool 26 with the carriage 25. The stool 26 includes a groove 265 defined in the front face in order to receive the vertical bar 252 when the stool 26 is put vertically.

Figure 5:
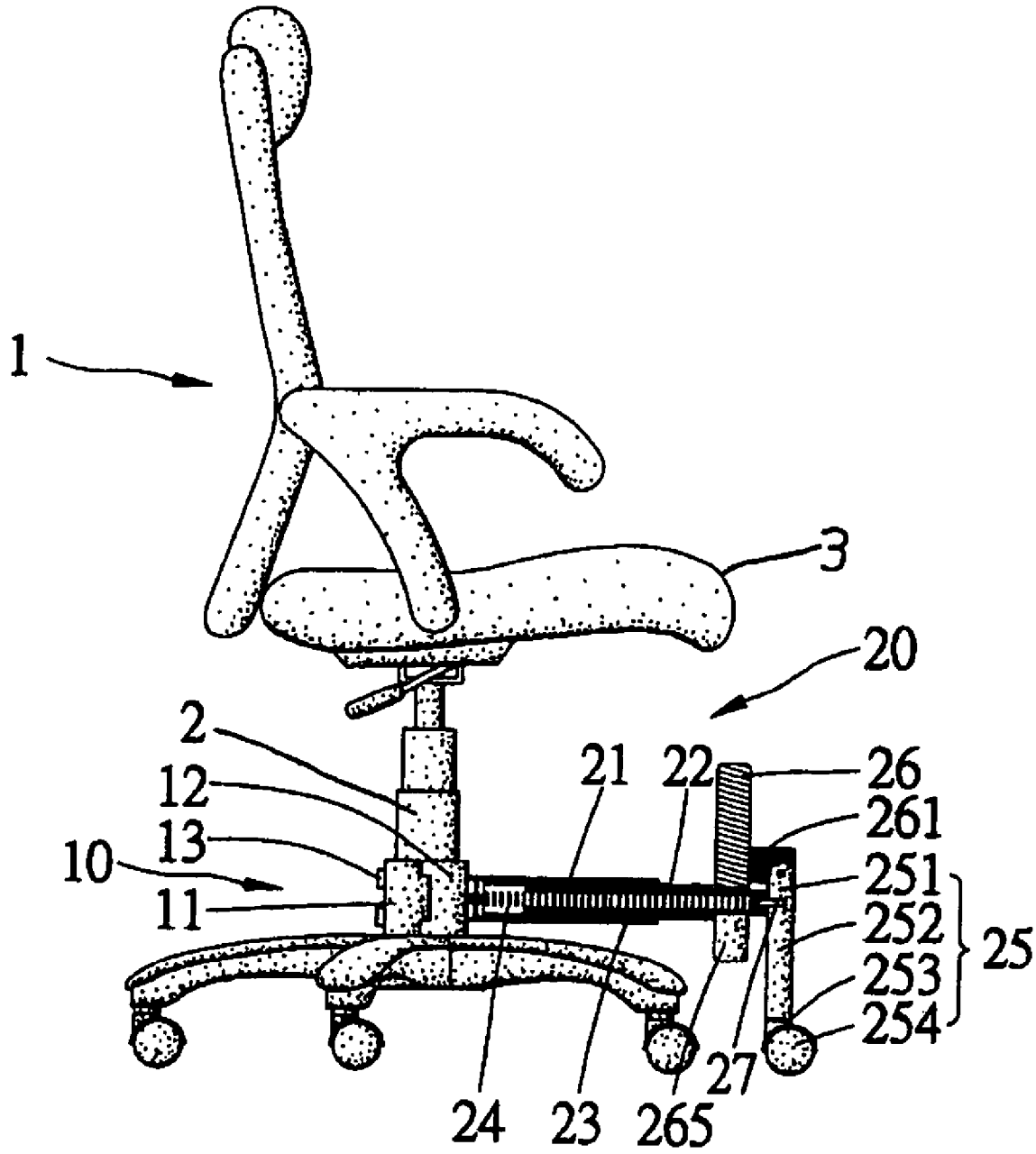
FIG. 5 is a side view, partially in cross-section, of the stool apparatus of FIG. 1.
Figure 6:
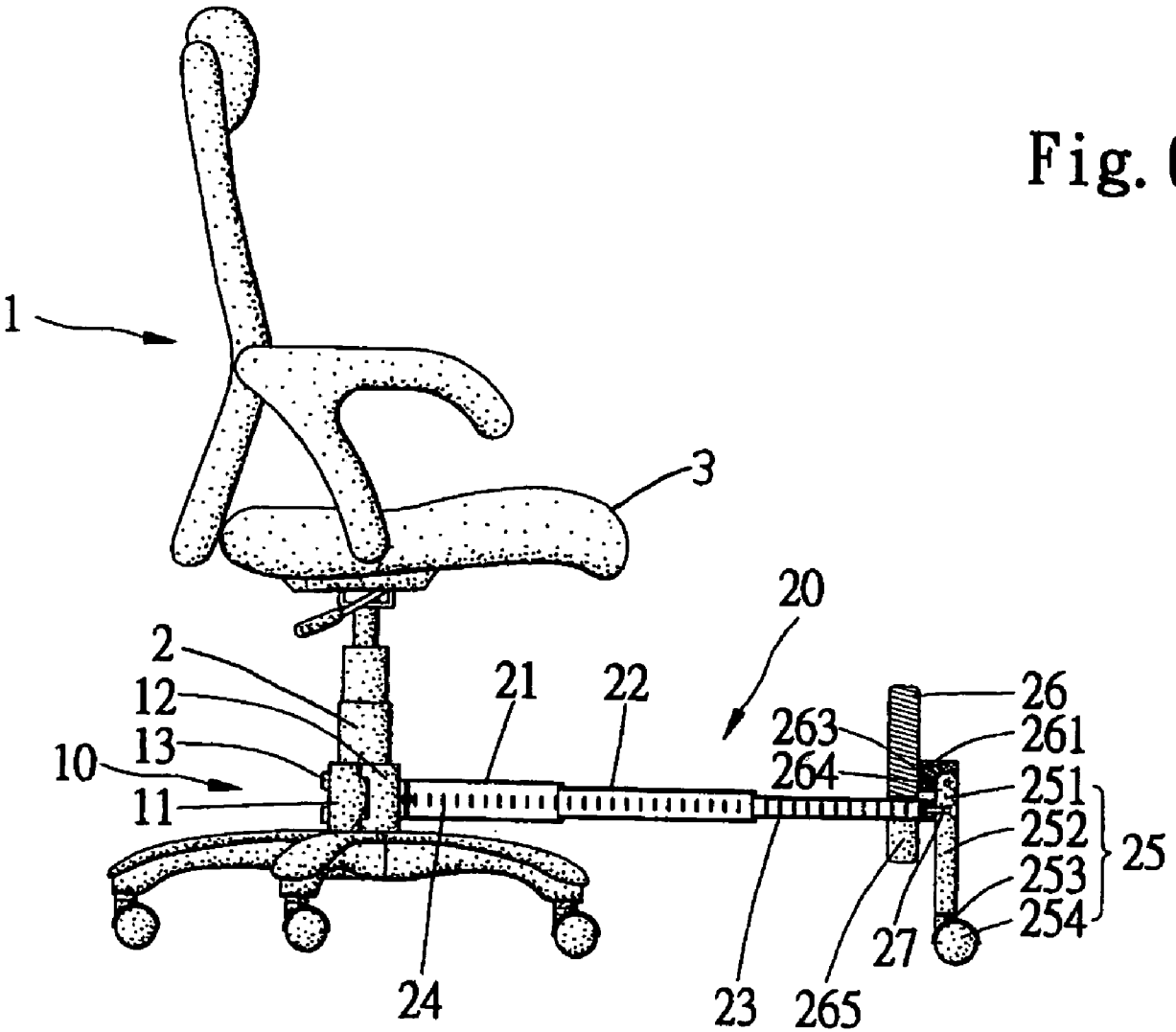
FIG. 6 is similar to FIG. 5 but shows the stool apparatus in a different position.

The stool 26 can be moved relative to the post 2 between a first horizontal position shown in FIG. 5 and a second horizontal position shown in FIG. 6. Thus, the stool apparatus 20 can suit users of different sizes, specifically legs of different lengths. Although not shown, the stool apparatus 20 can be put in various vertical positions on the post 2.

Figure 7:
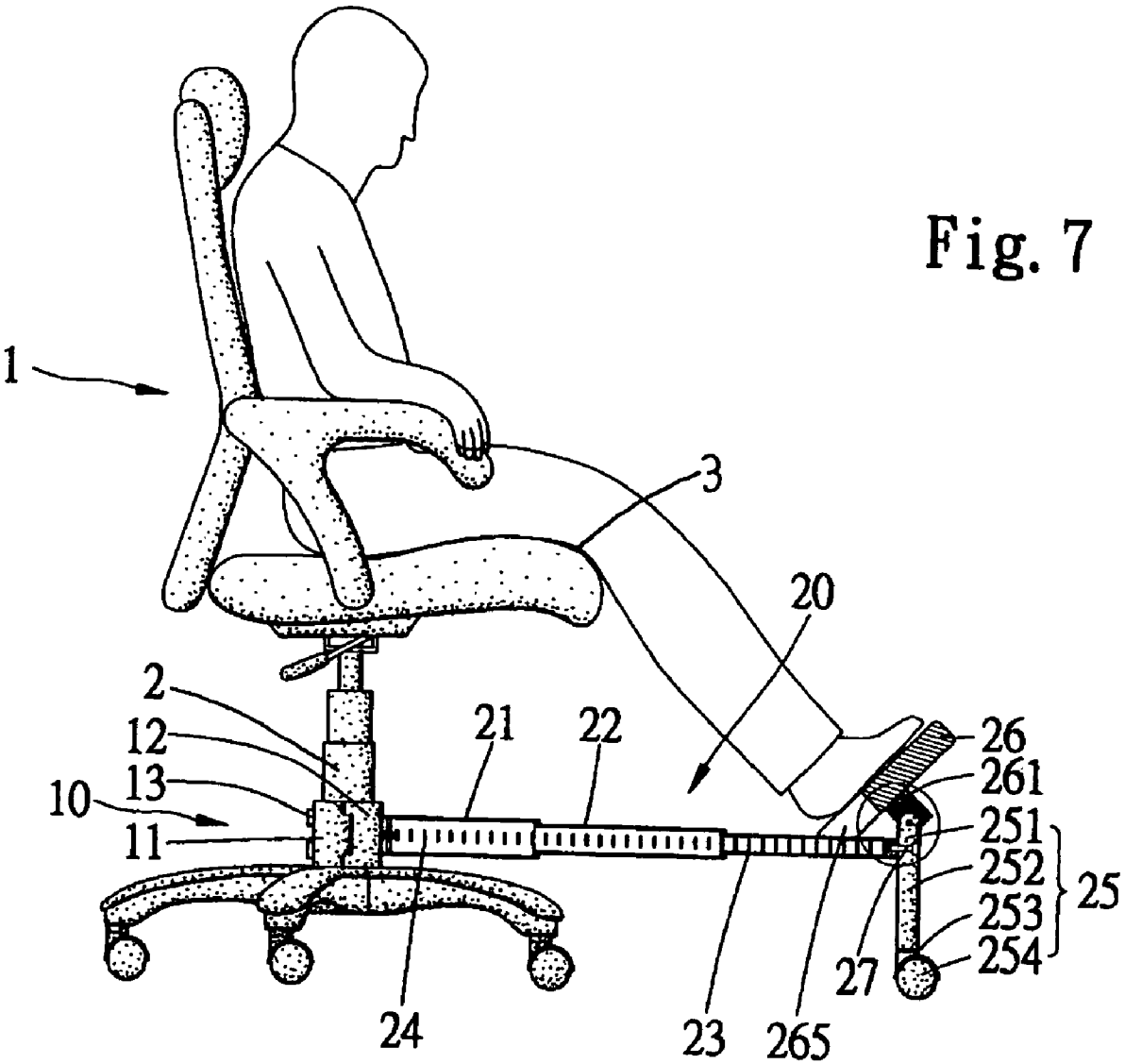
FIG. 7 shows a user using the stool apparatus shown in FIG. 6.

Referring to FIG. 7, a user can put his or her feet on the stool 26. The stool 26 is in a tilted position. The stool 26 is kept in the tilted position by a retaining device to be described referring to FIG. 8.

Figure 8:
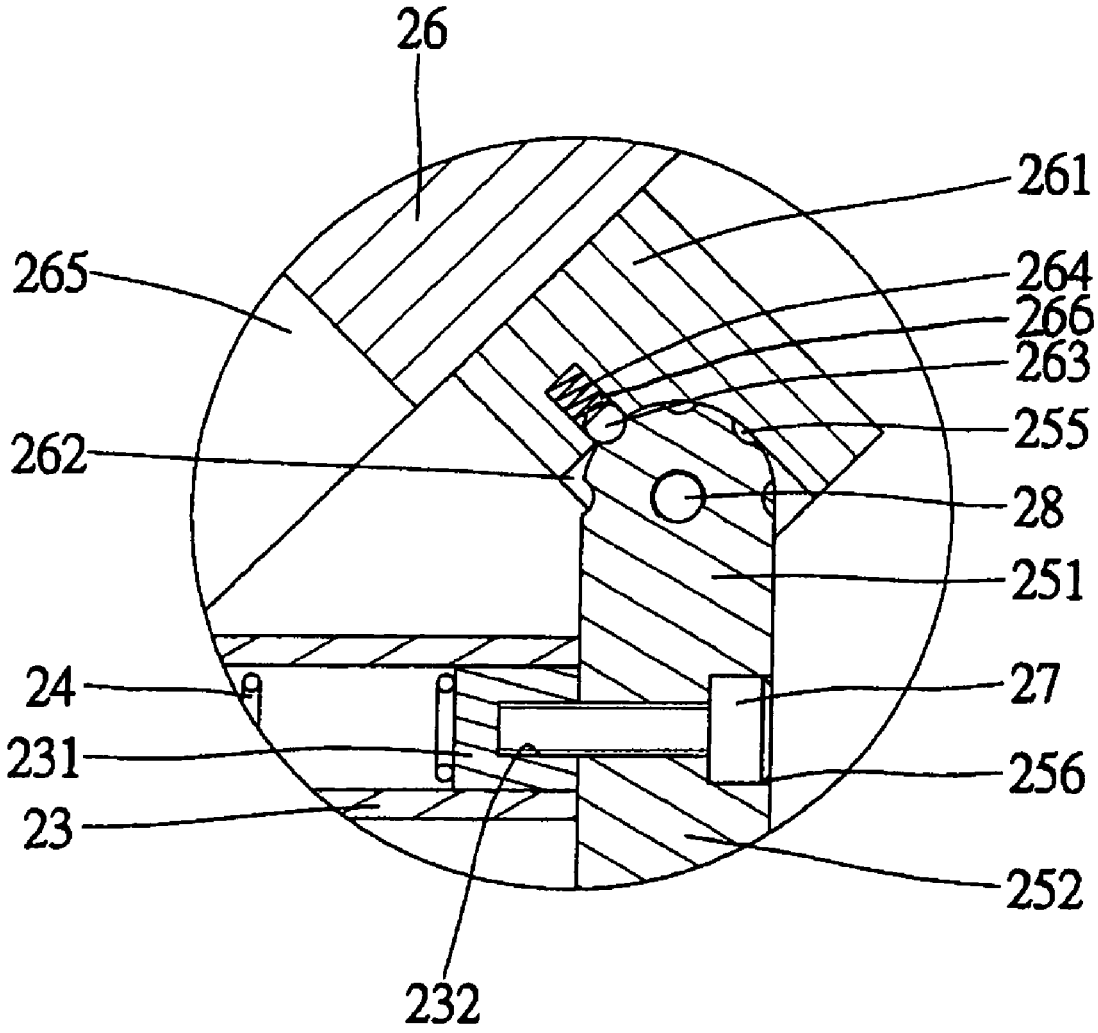
FIG. 8 is an enlarged, partial, cross-sectional view of the stool apparatus shown in the circle of FIG. 7.
Figure 9:
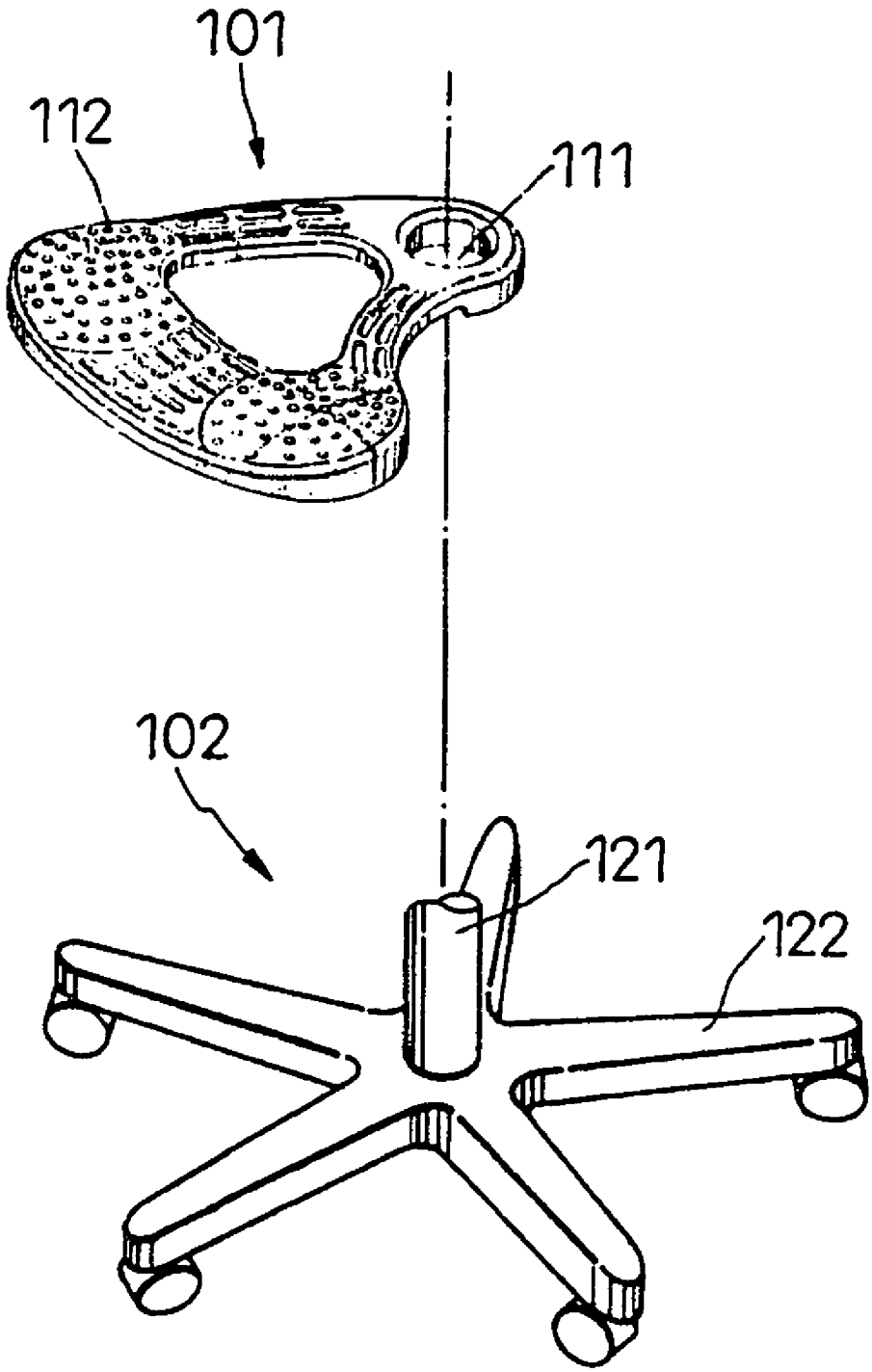
Fig. 9 PRIOR ART
FIG. 9 is a partial perspective view of a chair equipped with a conventional stool apparatus.
Figure 10:
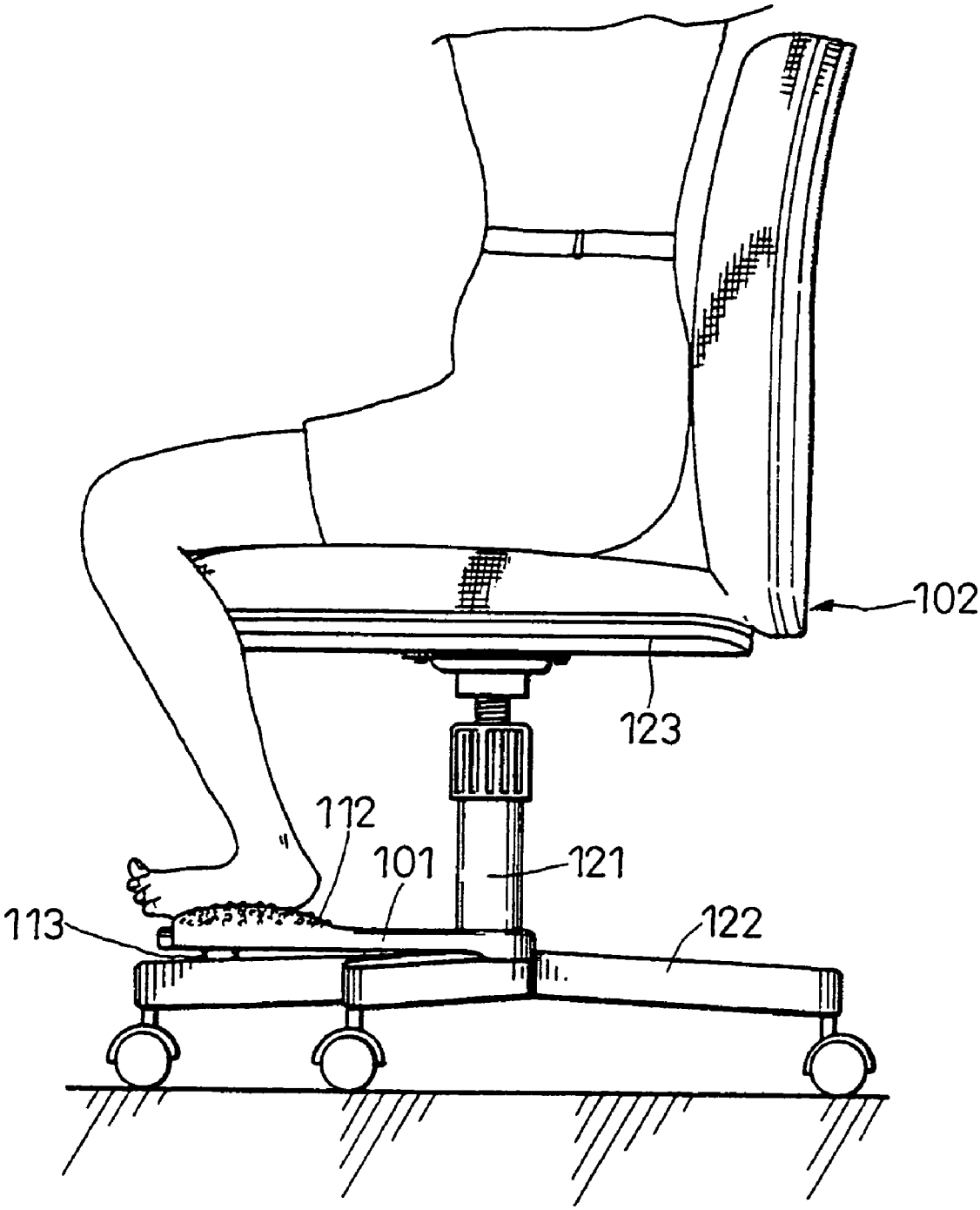
Fig. 10 PRIOR ART
FIG. 10 is a partial side view of the chair shown in FIG. 9.

Referring to FIG. 8, the retaining device includes a concave face 262 formed between the ears of lug 261. A hole 266 is defined in the concave face 262. A spring 264 and a detent 263 are put in the hole 266. A plurality of holes 255 are defined in the lug 251. One of the holes 255 receives the detent 263 50 as to retain the stool 26 in selective one of several positions relative to the carriage 25.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A stool apparatus for use in a chair with a post, the stool apparatus comprising a stool; a carriage for carrying the stool; a telescopic device for connecting the carriage to the post; and a clamping device for connecting the telescopic device with the post, wherein the clamping device includes a first jaw having first and second ends, a second jaw having first and second ends, with the first end of the second jaw hinged with the first end of the first jaw and at least one quick release element extending between the second ends of the first and second jaws for forcing the second end of the first jaw towards the second end of the second jaw, with the telescopic device secured to the second jaw intermediate the first and second ends of the second jaw, wherein the second end of the first jaw defines at least one cutout, and the second end of the second jaw defines at least one hole, and the quick release element includes a lever/cam for abutment against the second end of the first jaw adjacent the at least one cutout, a screw pivotally connected with the lever/cam and inserted in the cutout and the hole and a nut engaged with the screw and abutting with the second end of the second jaw adjacent the at least one hole, with the spacing between the nut and the lever/cam along the screw varying with pivoting of the lever/cam relative to the screw.

2. The stool apparatus according to claim 1 wherein the stool is pivotally installed on the carriage; and wherein the stool apparatus further comprises a retaining device for retaining the stool in position relative to the carriage, wherein the retaining device includes a detent installed in a detent hole at one of the carriage and the stool, with the detent being biased out of the detent hole by a spring received in the detent hole, and wherein the retaining device further includes at least one receiving hole defined in the other of the carriage and the stool for receiving the detent.

3. The stool apparatus according to claim 2 wherein the retaining device includes a plurality of receiving holes.

4. The stool apparatus according to claim 2 wherein the carriage comprises a vertical bar attached to the telescopic device, a horizontal bar integrated with the vertical bar and two wheels attached to the horizontal bar, with the retaining device located on the vertical bar spaced from the telescopic device, with the telescopic device being intermediate the retainer device and the horizontal bar.

5. The stool apparatus according to claim 4 wherein the carriage includes a lug formed thereon, with the at least one receiving hole located on the lug of the carriage, and wherein the stool includes two ears between which the lug of the carriage is located and connected, with a concave face formed between the two ears, with the detent hole formed in the concave face.

6. The stool apparatus according to claim 5 comprising a screw driven in the lug of the carriage and the ears of the stool.

7. The stool apparatus according to claim 6 comprising a nut engaged with the screw.

8. The stool apparatus according to claim 5 wherein the telescopic device defines a screw hole, and the carriage defines an aperture through which a screw is driven into the screw hole, with the aperture located intermediate and spaced from the lug and the horizontal bar.

9. The stool apparatus according to claim 4 wherein the stool includes a groove defined in a front face in order to receive the vertical bar when the stool is put vertically.

10. The stool apparatus according to claim 2 comprising a tension spring for shrinking the telescopic device.

11. The stool apparatus according to claim 10 wherein the tension spring is put in the telescopic device.

12. The stool apparatus according to claim 2 wherein the telescopic device comprises a first tube, a second tube inserted in the first tube and a third tube inserted in the second tube.

13. The stool apparatus according to claim 12 comprising a tension spring with a rear end attached to a rear end of the first tube and a front end attached to a front end of the third tube.

14. The stool apparatus according to claim 13 wherein the tension spring is put in the telescopic device.

15. The stool apparatus according to claim 12 wherein the carriage comprises a vertical bar attached to the third tube, a horizontal bar integrated with the vertical bar and two wheels attached to the horizontal bar.

* * * * *